US006431929B2

(12) United States Patent
Schäfer et al.

(10) Patent No.: US 6,431,929 B2
(45) Date of Patent: Aug. 13, 2002

(54) DRIVE SYSTEM

(75) Inventors: Wilhelm Schäfer; Heinz-Jürgen Bohmann, both of Witten (DE)

(73) Assignee: Renk Aktiengesellschaft, Augsburg (DE)

( * ) Notice: Subject to any disclaimer, the term of this patent is extended or adjusted under 35 U.S.C. 154(b) by 0 days.

(21) Appl. No.: 09/747,243

(22) Filed: Dec. 21, 2000

(30) Foreign Application Priority Data

Dec. 22, 1999 (DE) ..... 199 61 925

(51) Int. Cl.[7] ..... B63H 23/34
(52) U.S. Cl. ..... 440/83; 464/68; 192/107 R
(58) Field of Search ..... 464/68, 62, 66; 192/3.56, 107 R; 440/75, 83

(56) References Cited

FOREIGN PATENT DOCUMENTS

| | | | |
|---|---|---|---|
| GB | 2 326 862 | 1/1999 | ..... B63H/23/16 |
| GB | 2 342 634 | 4/2000 | ..... B63H/23/18 |

*Primary Examiner*—Jesus D. Sotelo
(74) *Attorney, Agent, or Firm*—Cohen, Pontani, Lieberman & Pavane

(57) ABSTRACT

A drive system includes a drive shaft with first and second shaft sections connected by a diaphragm clutch having a diaphragm assembly. The radially outer end of the diaphragm assembly is connected to a disk having a first toothing arranged on one face of the disk. The first toothing engages in corresponding second toothing on a flange connected to the first shaft section when the diaphragm assembly is subjected to an axial preload. A contact-pressure device that is controllable by remote control in the stationary condition acts against the disk to produce the preload.

5 Claims, 3 Drawing Sheets

DRIVE SYSTEM

BACKGROUND OF THE INVENTION

1. Field of the Invention

The invention relates to a drive system comprising a drive shaft having two shaft sections connected by a diaphragm clutch having a diaphragm assembly.

2. Description of the Related Art

A drive system having two shaft sections connected by a diaphragm clutch is used to drive a drive shaft in a flexible manner. In one application of this type of drive, a driving engine acts directly on the first shaft section and the second shaft section is connected by a clutch to an additional drive. If the driving engine fails in a drive of this kind, the additional drive assumes the driving of the drive shaft, usually with a reduced power. When the additional drive assumes the task of driving, the diaphragm clutch has to be disengaged.

A preferred application of this type of drive is in a ship's propulsion system in which the driving engine includes a two-stroke engine or a diesel engine that drives the propeller shaft. In a known ship's propulsion system of this kind (see German reference DE-A 197 29 046), the diaphragm clutch contains a screwed joint comprising tapered screw bolts secured by nuts. The diaphragm clutch is decoupled by releasing this screwed joint. This decoupling process requires time-consuming manual work.

German Patent Application 198 47 771.6 describes a separating device for releasing a first screwed joint of the diaphragm clutch known from DE-A 197 29 046. This separating device comprises a guide flange that is axially displaceable on the propeller shaft and carries a second screwed joint. The second screwed joint bridges the first screwed joint connecting the diaphragm assembly of the diaphragm clutch. To decouple the diaphragm clutch, the second screwed joint of the separating device is released, and the guide flange is displaced on the propeller shaft. Although the diaphragm assembly remains firmly connected at all times when this separating device is used, this separating device still requires manual work and is therefore time consuming.

SUMMARY OF THE INVENTION

The object underlying the invention is to provide a drive having two shaft sections connected via a diaphragm clutch with a separating device for releasing the diaphragm clutch that remotely operable.

According to the present invention, the object is achieved by a drive system having a drive shaft with first and second shaft sections and a diaphragm clutch having a diaphragm assembly arranged for connecting said first and second shaft sections. A disk having an end face with a first toothing is connected to a radially outer end of the diaphragm assembly. A flange is connected to the first shaft section and has a second toothing for engaging the first toothing when the diaphragm assembly is subjected to an axial preload, wherein the first and second shaft sections are connected by the diaphragm clutch when the first and second toothings are engaged under the preload. A contact pressure device is controllable via a remote control when the drive shaft is in a stationary position for selectively acting on the diaphragm assembly to produce the axial preload.

In the drive according to the present invention, the connection of the diaphragm clutch is established by the toothings and the axial preload on the diaphragm assembly. This axial preload may be built up and released by a hydraulic contact-pressure device that is remotely operable.

The object is also met by a propulsion system for a ship having a propeller counter shaft and a thrust shaft and a diaphragm clutch in which the connection of the diaphragm clutch is established by a toothing under axial preload as described above.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
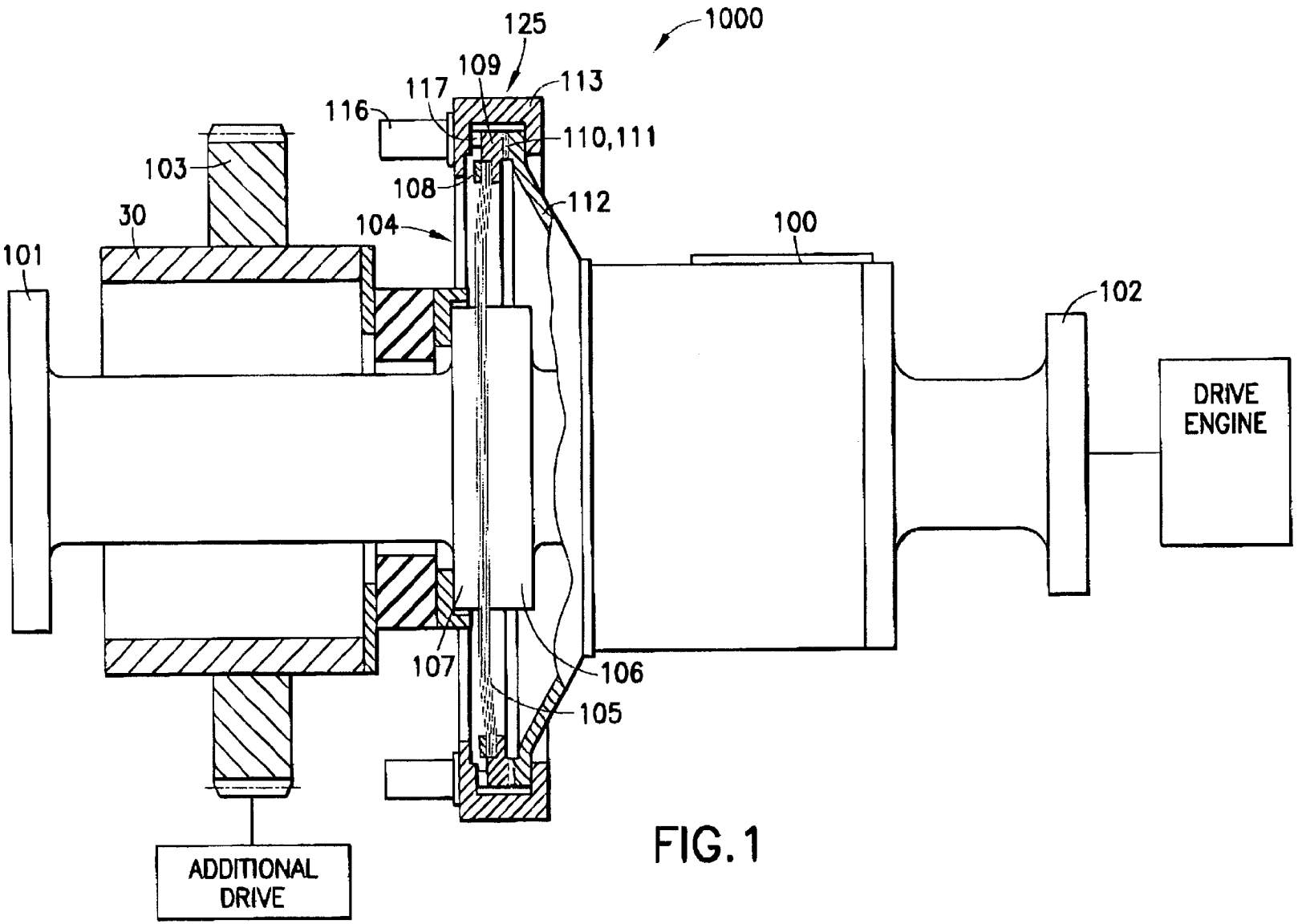
FIG. 1 is partial longitudinal sectional view of a drive shaft with a diaphragm clutch and a separating device according to an embodiment of the present invention.

A drive shaft 1000 according to an embodiment of the present invention is shown in FIG. 1. The drive shaft 1000 includes first and second shaft sections 100, 101. A driving flange 102 is arranged at one end of the first shaft section 100 to which a driving engine such as, for example, a diesel engine or a two-stroke engine is directly flanged. A hollow shaft 30 is secured to a flange 107 on the second shaft section 101 via a flexible coupling 20. A gearwheel 103 is arranged on the hollow shaft 30. The gearwheel 103 is selectively connectable via a transmission to an additional drive (shown schematically) so that the additional drive may selectively drive the second shaft section 101.

The first and second shaft sections 100, 101 are connected to each other via a diaphragm clutch 104 which is torsionally rigid but flexible in the axial direction. The diaphragm clutch 104 has a disk-shaped diaphragm assembly 105. The radially inner end of the disk-shaped diaphragm assembly 105 is clamped by bolts between the flange 107 on the second shaft section and another flange 106 at the mutually adjacent end of said first shaft section 100. The radially outer end of the diaphragm assembly 105 is connected to an annular disk 109 using screws via a counterring 108 of a separating device 125.

Figure 2A:
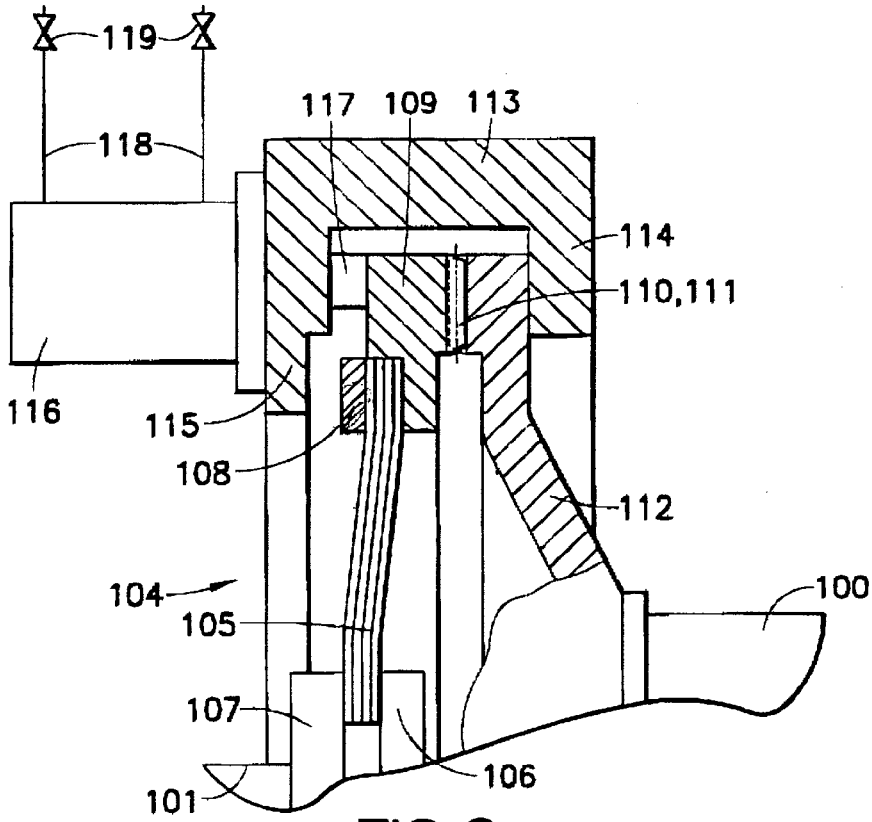
FIGS. 2*a* and 2*b* are two sectional views of the separating device showing two different operating states.

The detailed view of the diaphragm clutch 104 in FIG. 2*a* show that one face of the disk 109 has a radially extending toothing 110, which is preferably in the form of lash-free serrations. The toothing 110 on the disk 109 is suitable for engagement with a corresponding toothing 111 formed on a cover-shaped flange 112 which is secured to the first shaft section 100.

The separating device 125 further comprises a hoop-shaped ring 113 arranged around the disk 109 and the cover-shaped flange 112. The hoop-shaped ring 113 has two limbs 114, 115 which extend radially inward and overlap the region of the toothings 110, 111. The hoop-shaped ring 113 is firmly connected to the cover-shaped flange 112 (FIG. 2*a*).

A contact-pressure device designed as a hydraulic cylinder arrangement 116 is secured on the outside of the limb 115 of the hoop-shaped ring 113. The hydraulic cylinder arrangement includes a piston 117 arranged for acting on the disk 109 directly or indirectly via the hoop-shaped ring 113. When the cylinder arrangement 116 is actuated, the piston 117 extends out of the cylinder arrangement 116 and subjects the radial outer end of the diaphragm assembly 105 to an axial preload. In the extended position of the piston 117, the toothing 110 on the disk 109 engages in the toothing 111 on the cover-shaped flange 112 under the resulting preload on the diaphragm assembly 105 (FIG. 2*a*). In this position of the piston 117, a connection between the first and second shaft sections 100, 101 is established via the diaphragm clutch 104. Furthermore, the piston 117 is locked mechanically in the cylinder in the fully extended position to hold the diaphragm clutch 104 in engagement even if the pressure fails in the hydraulic cylinder arrangement 116.

Figure 2B:
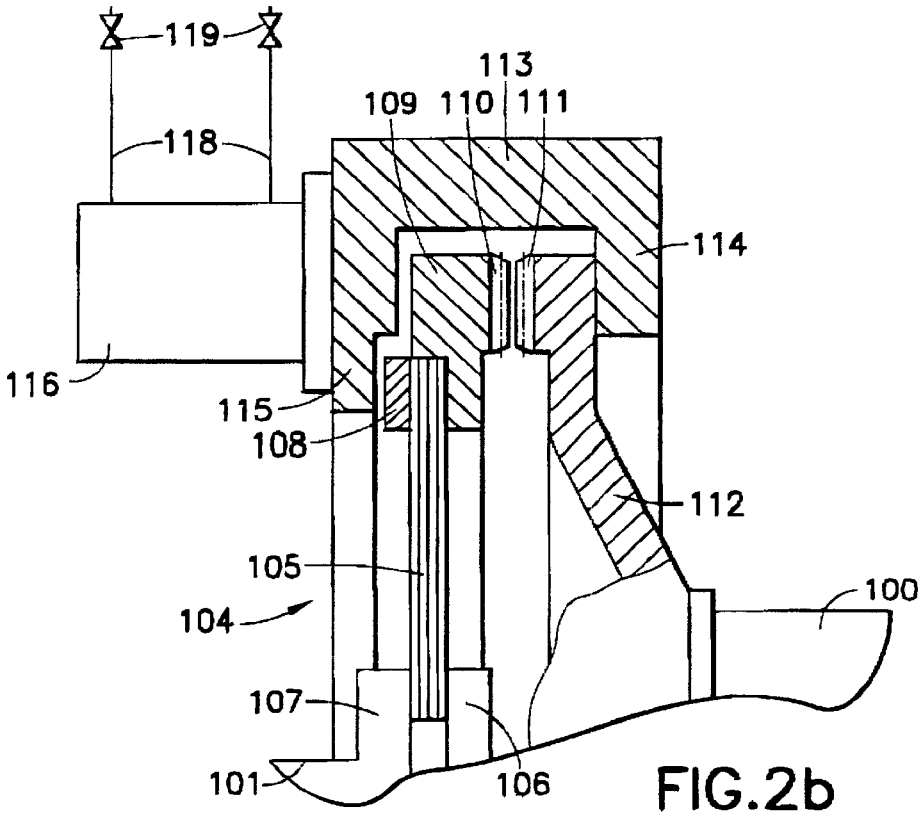

The spacing between the insides of the limbs 114, 115 of the hoop-shaped ring 113 is greater at least by the spring travel of the diaphragm assembly 105 than the radial thickness of the disk 109 and the cover-shaped flange 112 in the region of the toothing 110, 111. When the hydraulic pressure is released, the piston 117 moves toward the retracted position (FIG. 2*b*) which cancels the preload on the diaphragm assembly 105. As a result, the toothings 110, 111 on disk 109 and cover-shaped flange 112 disengage and the first and second shaft sections 100, 101 are separated.

Hydraulic lines 118 lead to the cylinder arrangement 116. Valves 119 arranged in these hydraulic lines 118 may be remote-controlled and are only connected when the drive shaft 1000 is in the stationary condition. When the system rotates, the piston 117 is mechanically locked. Conversely, when the drive shaft 1000 is stationary, the piston 117 is released.

Figure 3:
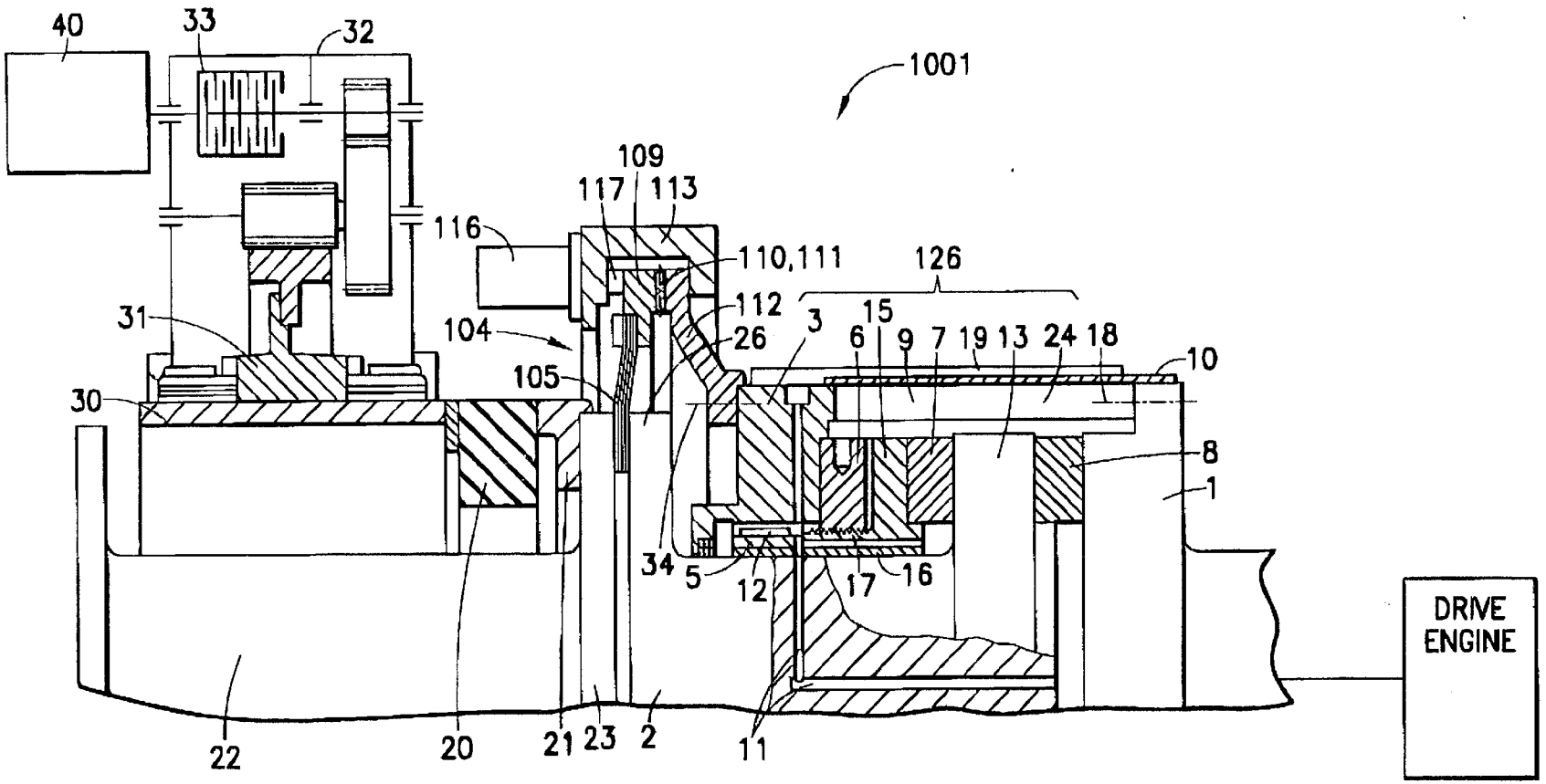
FIG. 3 is a longitudinal sectional view of a ship's propulsion system including the separating device according to the present invention.

Apart from the case of a drive shaft consisting of two shaft sections, the separating device 125 described above for the diaphragm clutch 104 of a drive 1000 may be used in any shaft systems in which the flow of torque is required to be interrupted by remote control. One preferred application is in single-engined ships with a two-stroke engine connected directly to the propeller by a shaft line. A ship's propulsion system 1001 of this kind is illustrated in FIG. 3.

The driving engine of a ship's propulsion system which may, for example, include a low-speed diesel engine or a two-stroke internal combustion engine, is connected to a propeller countershaft 22 (second shaft section) by means of a drive-side flange 1 attached to a thrust shaft 2 (first shaft section) and by the diaphragm clutch 104 which is arranged between the thrust shaft 2 and the propeller countershaft 22. The connection between the propeller countershaft 22 and the propeller shaft proper, including the propeller secured to the latter, is not shown here. The drive 1001 shown in FIG. 3 is a so-called direct drive, in which the desired speed of the propeller is set by adjusting the speed of the driving engine. It is not necessary to arrange a transmission between the driving engine and the propeller. To ensure that the ship remains maneuverable even if the driving engine fails, an additional drive is provided including an electric machine 40, which can be operated either as a motor or a generator. The electric machine 40 is connected to a transmission 32 by a clutch 33. In this exemplary embodiment, the transmission 32 is a two-stage input transmission with a large gearwheel 31 secured on the hollow shaft 30 surrounding the propeller countershaft 22. The transmission 32 is connected to the propeller countershaft 22 by a highly flexible coupling 20 which is connected to the propeller countershaft 22 via an annular split flange 21. For this purpose, the propeller countershaft 22 likewise has a flange 23 for connection to the annular split flange 21.

The propeller thrust is transmitted to a thrust bearing (not shown), arranged in the driving engine, via forward-thrust blocks 8 and reverse-thrust blocks 7. The forward-thrust blocks 8 are secured on a face of a flange 13 on the thrust shaft 2 that faces the drive side flange 1. The reverse-thrust blocks 7 are secured on a face of a flange 15 of a receiving collar 5 that faces the flange 13 of the thrust shaft 2. The receiving collar 5 is arranged in an axially displaceable manner on a sliding-contact bearing 16 secured on the thrust shaft 2. The receiving collar 5 includes a cylindrical part with a threaded section 17. A threaded ring 6 is arranged rotatably on the threaded section 17. An end of the threaded ring 6 facing away from the drive side is supported against the inner surface of a bell-shaped supporting collar 3. The supporting collar 3 is connected firmly to the drive-side flange 1 by bolts 18. The axial displacement of the receiving collar 5 is effected by a key 12 which is inserted into a recess in the cylindrical part of the receiving collar 5 and engages in an axially extending slot in the supporting collar 3. The supporting collar 3 is supported on the thrust shaft 2 by the cylindrical part of the receiving collar 5 and the sliding-contact bearing 16. The supporting collar 3 comprises two annular parts, which are connected to one another by a screwed fastening 19 at the joint. The thrust blocks 7, 8 are lubricated via passages 11 that are arranged in the supporting collar 3, the receiving collar 5 and the thrust shaft 2 and open into intermediate spaces, in which the thrust blocks 7, 8 are arranged.

The propeller is driven by the driving engine during normal operation and the thrust blocks 7, 8 are clamped against the flanges 1, 13 by rotation of the threaded ring 6, with the result that the propeller thrust is introduced via this connection into the above-mentioned thrust bearing arranged in the driving engine. The torque is transmitted via the diaphragm clutch 104 of torsionally rigid but axially flexible construction illustrated in FIGS. 1 and 2 and explained in detail above. The diaphragm assembly 105 of the diaphragm clutch 104 is clamped between the flange 23 of the propeller countershaft 22, on the one hand, and the flange 26 of the thrust shaft 2, on the other hand. The requisite connection between the diaphragm clutch 104 and an auxiliary thrust bearing 126 is made by bolts 34, which connect the cover-shaped flange 112 of the diaphragm clutch 104 to the supporting collar 3.

For emergency operation, the additional drive described at the outset is activated, and the electric motor 40 drives the transmission 32 via the clutch 33 and the propeller countershaft 22 via the flexible coupling 20. Since this additional drive has a significantly lower power than the driving engine, the propeller thrust is also reduced accordingly. It must nevertheless be absorbed. This is accomplished by releasing the clamping by turning the threaded ring 6 in the opposite direction by means of an opening 9 formed at the outside of the supporting collar. The protective cover 10 over the opening 9 must first of all be removed. Via this, the diaphragm clutch 104 must be released in the manner described in detail above to ensure that no torque can be transmitted between the propeller countershaft 22 and the supporting collar 3. Once the clamping forces are eliminated, the thrust blocks 7, 8 have play. In the case of forward travel in the emergency mode, the forward-thrust blocks 8 come to rest against the stationary drive-side flange 1 and transmit the reduced propeller thrust statically. The frictional heat produced in the process has to be dissipated.

Depending on the power to be transmitted, complete filling of the auxiliary thrust bearing 126 may be sufficient, or forced lubrication via the above-mentioned passages 11 may be required. In the case of reverse travel in the emergency mode, the flange 13 of the thrust shaft 2 comes to rest against the reverse-thrust blocks 7, and the reduced propeller thrust is passed into the thrust bearing arranged in the driving engine via the stationary receiving collar 5, the threaded ring 6, the supporting collar 3 and the drive-side flange 1 connected thereto.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A drive system, comprising:

a drive shaft having first and second shaft sections;

a diaphragm clutch having a diaphragm assembly arranged for connecting said first and second shaft sections;

a disk having an end face with a first toothing, wherein a radially outer end of said diaphragm assembly is connected to said disk;

a flange connected to said first shaft section and having a second toothing for engaging said first toothing when said diaphragm assembly is subjected to an axial preload, wherein said first and second shaft sections are connected via said diaphragm clutch when said first and second toothings are engaged under said axial preload; and a contact pressure device controllable via a remote control when said drive shaft is in a stationary position for selectively acting on said diaphragm assembly to produce said axial preload.

2. The drive system of claim 1, wherein the contact-pressure device comprises a hoop-shaped ring having two radially inwardly extending limbs overlapping said first and second toothings on said disk and said flange, a hydraulic cylinder arrangement secured to an outer side of said hoop-shaped ring including a piston arranged for acting against said disk, wherein said hoop-shaped ring is secured on one of said disk and said flange, and wherein a spacing between said limbs is greater than a radial thickness of said disk and said flange in a region of said first and second toothings by at least a spring travel of said diaphragm assembly.

3. The drive system of claim 2, wherein said piston is movable from a retracted position to an extended position and is mechanically lockable in the retracted position and in the extended position.

4. The drive of claim 1, wherein said first and second toothings comprise radial lash-free serrations.

5. A propulsion system for a ship, comprising:

a propeller countershaft;

a driving engine operatively connected to said propeller countershaft without a transmission for driving said propeller countershaft during a normal operation, wherein a thrust of said propeller countershaft is absorbable by a thrust bearing in said driving engine;

an additional drive comprising an electric machine operable as a generator and a motor;

a transmission comprising a gearwheel surrounding said propeller countershaft;

a flexible coupling arranged for connecting said gearwheel to said propeller countershaft, wherein said additional drive is connected to said transmission for driving said propeller countershaft during emergency operations;

a thrust shaft having drive side flanges and a lash-free releasable connection between said propeller countershaft and said driving engine, said thrust shaft being coupled to an auxilliary thrust bearing having forward thrust blocks and reverse thrust blocks which are activated during said emergency operation of said propulsion system for absorbing the reduced thrust of said additional drive;

a diaphragm clutch connected between said propeller countershaft and said auxiliary thrust bearing and having a diaphragm assembly for forming said lash-free releasable connection of said thrust shaft, said auxiliary thrust bearing being clamped against said drive side flanges during said normal operation of said propulsion system;

a disk having an end face with a first toothing, wherein a radially outer end of said diaphragm assembly is connected to said disk;

a flange connected to said thrust shaft and having a second toothing for engaging said first toothing when said diaphragm assembly is subjected to an axial preload, wherein said propeller countershaft and said thrust shaft are connected via said lash-free releasable connection when said first and second toothings are engaged under said axial preload; and a contact pressure device controllable via a remote control when said drive shaft is in a stationary position for selectively acting on said diaphragm assembly to produce said axial preload.

* * * * *